United States Patent [19]

Wood

[11] Patent Number: 4,638,749

[45] Date of Patent: Jan. 27, 1987

[54] AUTOMATED SYSTEM FOR SEQUENTIALLY LOADING LOWERMOST SEGMENTS FROM A SHINGLED STACK OF LIMP MATERIAL SEGMENTS

[75] Inventor: George A. Wood, Lincoln, Mass.

[73] Assignee: The Charles Stark Draper Laboratory, Inc., Cambridge, Mass.

[21] Appl. No.: 850,237

[22] Filed: Apr. 10, 1986

[51] Int. Cl.[4] ..... D05B 21/00

[52] U.S. Cl. ..... 112/121.12; 112/121.29; 271/131

[58] Field of Search ..... 112/121.29, 121.12, 112/121.11, 121.15; 271/131, 133

[56] References Cited

U.S. PATENT DOCUMENTS

| | | | |
|---|---|---|---|
| 2,637,609 | 5/1953 | Berg | 271/133 X |
| 3,917,259 | 11/1975 | Salvade | 271/133 |
| 4,428,315 | 1/1984 | Keeton | 112/121.29 X |
| 4,483,529 | 11/1984 | Watanabe | 271/131 |
| 4,524,706 | 6/1985 | Bell | 112/121.29 |
| 4,557,472 | 12/1985 | Hannon | 271/131 |

*Primary Examiner*—H. Hampton Hunter
*Attorney, Agent, or Firm*—Lahive & Cockfield

[57] ABSTRACT

A system for selectively loading the lowermost segment of a shingled stack of limp material segments, where each segment includes one or more adjacent layers of said limp material, and wherein adjacent segments of said stack are laterally offset along a reference axis. The system includes a substantially planar surface adapted to support the shingled stack thereon, in a position so that the leading edge of the lowermost segment is adjacent to a reference point along the reference axis. A selectively operable extractor transports the lowermost segment in the direction of the reference axis and away from the stack. The extractor includes one or more sets of hinged jaws positioned for movement in the direction of the reference axis between the reference point and a point displaced from the reference point along the reference axis. The sets of jaws are adapted to selectively grip a portion of the leading edge of the lowermost segment when that leading edge is adjacent to the reference point.

7 Claims, 5 Drawing Figures

AUTOMATED SYSTEM FOR SEQUENTIALLY LOADING LOWERMOST SEGMENTS FROM A SHINGLED STACK OF LIMP MATERIAL SEGMENTS

REFERENCE TO RELATED APPLICATIONS

The subject matter of this application is related to that of U.S. patent application Ser. No. 707,608, filed Mar. 4, 1985, entitled "Assembly System for Seamed Articles". U.S. Pat. No. 4,401,044, entitled "System and Method for Manufacturing Seamed Articles", U.S. Pat. No. 4,457,243, entitled "Automated Seam Joining Apparatus", and U.S. Pat. No. 4,512,269, entitled "Automated Assembly System for Seamed Articles".

BACKGROUND OF THE INVENTION

This invention relates to systems for automated, or computer-controlled, assembly of seamed articles from limp material. In particular, this invention relates to a system for automatically loading limp material segments for assembly by an automated assembly device.

For many years now, conventional assembly line manufacture of seamed articles constructed of limp fabric has incorporated a series of manually controlled assembly operations. Generally tactile presentation and control of the fabric-to-be-joined is made to the joining, or sewing, head under manual control. One drawback of this assembly technique is that the technique is labor intensive; that is, a large portion of the cost for manufacture is spent on labor. To reduce cost, automated or computer-controlled manufacturing techniques have been proposed in the prior art.

The above-referenced patent application and patents disclose a set of assembly-related techniques that are readily adapted for, or particularly useful in the automated assembly of seamed articles from limp material. In particular, U.S. patent application Ser. No. 707,608 discloses an automated seamed garment assembly system which is adapted to receive segments of limp material at a loading table. That system then automatically transports those segments to a folding station, where they are folded so that desired seamed are aligned, and finally presents the folded segments to a seam forming apparatus where the seams are joined, all under machine control. Application Ser. No. 707,608 is incorporated by reference herein.

In the garment assembly field, the limp material segments for an article are generally pre-cut in batches, and stacks of similarly shaped pairs of elements-to-be-joined are typically generated. With the prior art manual assembly techniques, human operators generally select the pairs of elements-to-be-joined and manually control the assembly for the selected pairs, matching color, texture, pattern alignment all by hand. For the prior art automated assembly devices, such as that disclosed in the above-referenced application Ser. No. 707,608, the actual transfer or loading of the limp material segments may also be accomplished manually, for example, by an operator who one-at-a-time loads pairs of elements-to-be-joined to the receiving (or loading) table. With this approach, the operator may use "human" skills in distinguishing and mutually aligning edges, patterns, and colors for various elements-to-be-joined so that those elements may be joined in a desired alignment by subsequent seam-forming operations.

While this manual loading approach is effective, due to human abilities to sort by visual characteristics and to perform manual alignments, a relatively high level of skill is required to accomplish the one pair at a time manual loading. Moreover, this manual loading results in the relatively inefficient use of such human operators since one has to be standing by on a continuous basis to perform the one-at-a-time loading in step with the assembly throughput characteristics of the automated article assembly system.

Accordingly, it is an object of the present invention to provide an improved system for automatic assembly of seamed articles.

Another object is to provide an improved automated assembly system for seamed articles including an automatic loading assembly for use with an automated seamed article assembly system.

Yet another object is to provide an automated system for selecting the lowermost segment of a shingled stack of limp material segments.

SUMMARY OF THE INVENTION

Briefly, the present invention is an automatic loading system for selectively loading the lowermost segments of a shingled stack of limp material segments to, for example, the receiving, or loading, station of an automated article assembly system. As used herein, the term "shingled stack" refers to a stack of limp material segments where adjacent segments of a stack are laterally offset by a predetermined minimum distance sufficient to permit gripping of that segment so that it may be extracted from the stack. A segment in a shingled stack may include two adjacent "good side in" limp material elements cut for subsequent assembly into a sleeve, for example, as described in the referenced application Ser. No. 707,608. In a shingled stack, each segment may be a single limp material element or layer, or may be a set of two or more adjacent limp material elements, all associated for assembly together. Generally, it is desired to extract a segment from the stack in a manner maintaining the integrity of layers in that extracted segment, as well as layers in adjacent segments.

More particularly, the automatic loading system of the present inventory may include an endless belt transport system which defines a substantially planar transport surface adapted to support the shingled stack of limp material segments. The belt transport system may have the form of a single wide belt, or a plurality of substantially parallel, transversely spaced apart belts. The belt transport system further includes an associated drive motor for driving the belts to selectively transport a stack on the belts in the direction of a reference axis.

A detector is positioned with respect to the belt assembly in a manner permitting detection of points in time when the leading edges of the lowermost segment of a shingled stack being transported on the belt system passes a reference point along the reference axis.

With the leading edge overlying detector, a selectively operable extractor is adapted to transport the lowermost segment from the stack in the direction of the reference axis and away from the stack.

A selectively operable limiter is adapted for applying a limit force to one or more adjacent segments of this stack including the next to lowermost segment, but not the lowermost segment of the stack.

The loading system further includes a controller which is responsive to the detector, and is adpated to cyclically control operation of the various elements of the system.

In operation, following the loading of a lowermost segment from the stack in a previous cycle, the controller controls the operation of the motor drive to advance the shingled stack in the direction of the reference axis until the leading edge of the lowermost segment passes the reference point. Then, and for the duration of the cycle, the controller controls the belt system to maintain the stack stationary. Following the time when the leading edge passes the reference point, the controller controls the limiter to apply the limit force to the various elements of the stack, excepting the lowermost segment. In some forms of the invention, the limit force may be in the form of a vacuum force which selectively removes the load from the lowermost segment of the stack, by raising one or more of the adjacent remaining segments. In other forms of the invention, for example, the limiter may be in the form of a device for applying a downward force pinning all but the lowermost segment against the support surface for the stack.

In association with the initiation of the operation of the limiter in a cycle, the controller controls the extractor to perform its transporting of the lowermost segment away from the stack.

With this configuration, human operations are only minimally required for the automated article assembly process. More particularly, a relatively low skill level operator need only select segments from a stack of pre-cut segments and establish in rapid succession a shingled stack of segments on the support surface of the belt system. The only constraint is that the various segments be laterally offset to form the "shingled" effect. All additional orientation, such as that required by prior art systems, may be accomplished by the automated assembly device in using its vision and manipulation systems. Any necessary color or pattern sorting can also be accomplished at this time.

Moreover, by placing the sole human operation of stacking at the beginning of the assembly process, and by virtue of the ease and great speed at which this shingled stacking can be done, a highly efficient utilization of even a low skilled operator can be effected. One operator can easily, and in a very short time, establish a shingled stack for an automatic loading system with enough segments so as not to limit its throughput, and then the operator is free to assume other duties. There is no requirement for the continuous attention of a relatively highly skilled operator, as in the prior art.

BRIEF DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENT

Figure 1:
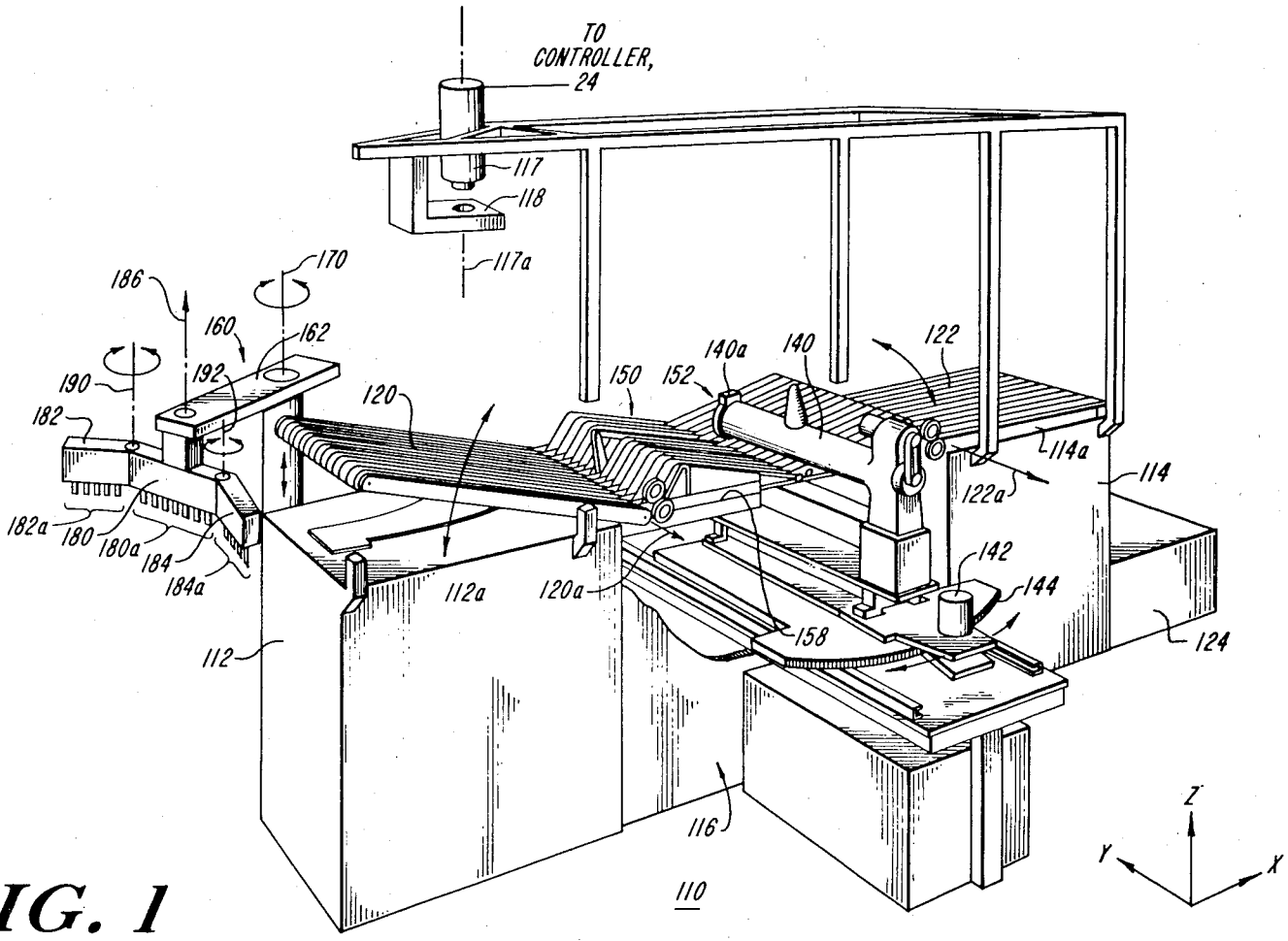
FIG. 1 shows an isometric representation of the principal elements of an exemplary embodiment of an automatic seamed article assembly system.
Figure 2:
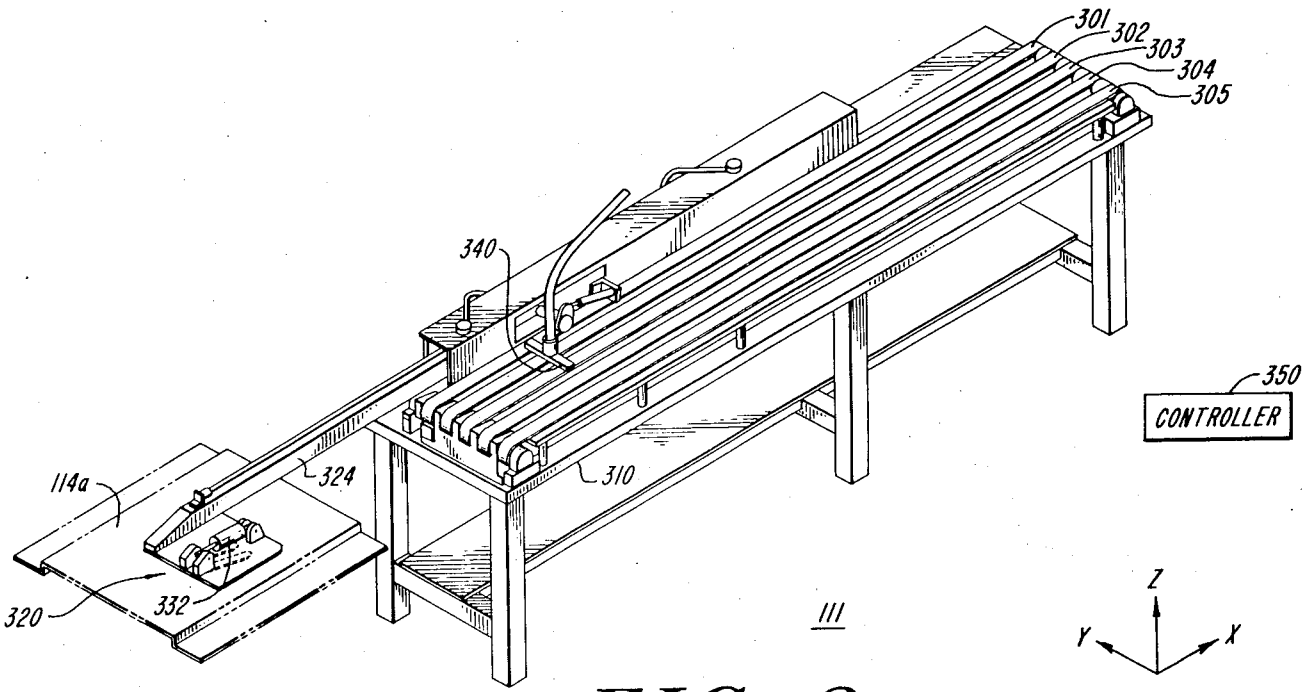
FIG. 2 shows an isometric representation of the principal elements of an exemplary automatic loading system in accordance with the present invention.

FIG. 1 shows an isometric representation of the principal elements of a seamed article assembly system 110, together with a set of intersecting reference coordinate axes X, Y and Z. FIG. 2 shows an isometric representation of the principal elements of an automatic loading system 111 embodying the present invention and adapted for use with the assembly system 110.

The system 110 generally has the form of, and operates in a similar manner to, the correspondingly numbered system described in U.S. patent application Ser. No. 707,608. The system 110 includes a vision system support table 112, a loading support table 114 and a seam joining assembly 116. The system 110 further includes an optical sensor system overlying table 112 and including a television camera 117 and a common-axis illumination system 118. In alternative forms, an additional optical sensor system may similarly overlie table 114, for use in loading or unloading and orienting limp material elements, for example. Each of the support tables 112 and 114 includes a respective one of planar upper surfaces 112*a* and 114*a*.

A set of parallel endless belts (120 and 122, respectively) is affixed to each of tables 112 and 114. Each set of belts 120 and 122 is pivotable about a respective one of axes 120*a* and 122*a* from a position substantially parallel to one of surfaces 112*a* and 114*a* (closed), as shown in FIG. 1, to a position substantially perpendicular to one of those surfaces (open). In FIG. 1, belt set 120 is shown in a partially open position, and belt set 122 is shown in a closed position substantially parallel to the top surface 114*a* of table 114. For loading limp material sections onto surface 114*a*, the belt assembly 122 is retracted to its full open position, thereby making the surface 114*a* fully available for receiving segments.

The loading system 111 is shown in isometric form in FIG. 2, together with a set of reference coordinate axes X, Y and Z. The system 111 is shown in top elevation view in FIG. 3 and side elevation view in FIG. 4. As shown, the loading system 111 includes an endless belt transport system including a set of parallel, transversely spaced-apart endless belts 301–305 mounted on a support table 310. In other embodiments, a single wide belt, or a different number of belts may be used. A belt drive motor 312 (not shown in FIGS. 2 or 3) is adapted to selectively drive the belts 301–305. Under the control of motor 312, the belts may be selectively driven together with their uppermost surfaces establishing a substantially planar support surface which is movable along a reference axis extending in the X-direction.

Figure 3:
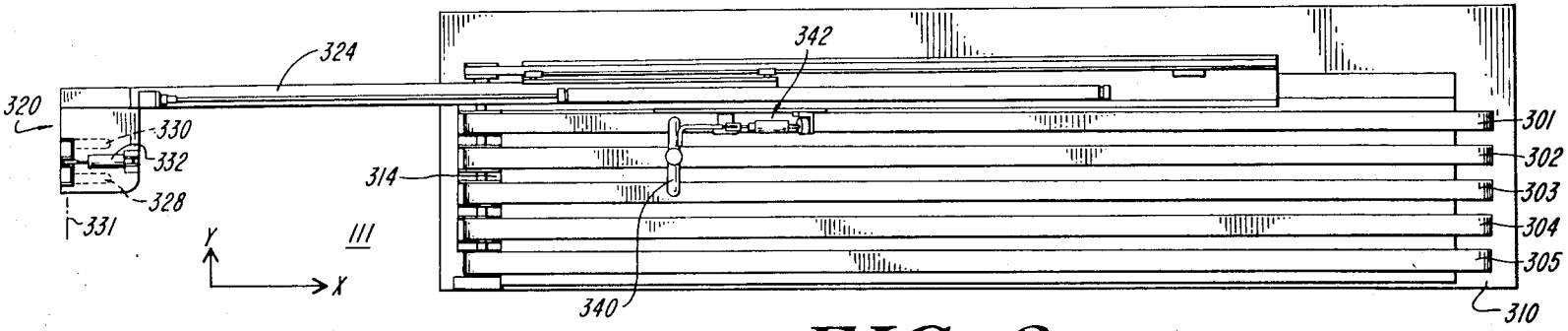
FIGS. 3 and 4 show plan and side elevation views, respectively, of the automatic loading system of FIG. 2.

A photodetector 314 is shown in FIG. 3. The detector 314 is adapted, as described below, to provide a signal indicative of whether or not a limp material segment overlies that detector on the support surface defined by the top surface of belts 301–305. In alternative embodiments, the detector 314 has some other form, for example, a pressure sensor, or any known device that might serve to initiate operation upon the detection of the leading edge of the lowermost segment at a predetermined point.

Figure 4:
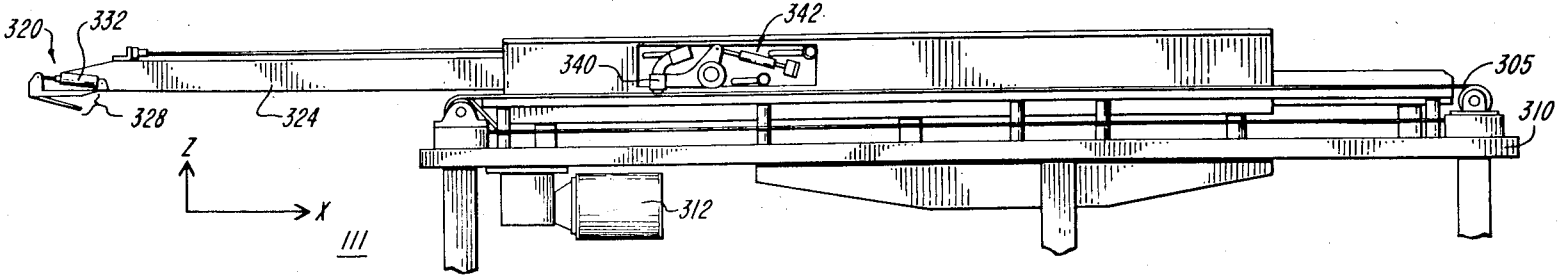

The loading system 111 also includes an extractor, or gripper, assembly including a gripper 320 affixed to an extendable arm 324 which is selectively driven by a pneumatic actuator (not shown). The gripper 320 in the illustrated embodiment includes two sets of hinged jaws 328 and 330 which are pivotable about an axis 331 parallel to the Y axis under the control of a pneumatic actuator 332. The gripper 320 and arm 324 are adapted for controlled motion in the direction of the X axis between an extended point (as shown in FIGS. 2–4) where gripper 320 overlies surface 114a, and a retracted point where the distal tips of jaws 328 and 330 lie between belts 301/302 and 302/303, respectively (as shown in FIG. 5).

The present embodiment of loading system 111 also includes a three position vacuum nozzle 340 and associated linkage and pneumatic actuator assembly 342. In alternative embodiments, the extractor assembly may have some other form for applying a force to leading edge of the lowermost segment in order to extract that segment from the stack. The nozzle 340 and linkage and actuator assembly 342 are adapted to selectively position the nozzle 340 in a "first" position as shown in FIG. 4, so that its outlet is adjacent to the support surface defined by belts 301–305. The nozzle 340 and assembly 342 are also adapted to selectively retract the nozzle outlet to a "second" position slightly displaced (e.g. ⅛ to ¼ inch) above the support surface, or to a "third" position well above the support surface. The position of nozzle 340 in the X direction is selected for expected workpiece segment length, preferably so that when the leading edge of the lowermost segment in a stack overlies detector 314, the nozzle 340 overlies the second lowermost segment in the stack just beyond the trailing edge of the lowermost segment.

A controller 350 (shown in block diagram form in FIG. 2), which may be a programmed digital computer, provides overall coordination and control of the above-described elements to accomplish cyclical operation of the loading system 111 in the following manner. In other forms of the invention, the control may be accomplished by the operation of a plurality of pneumatic valves in a predetermined timed sequence or as controlled by a mechanical linkage. In the presently described embodiment, initially, with actuator 342 controlling vacuum nozzle 340 to its third (i.e. uppermost) position, a shingled stack is established on the support surface provided by belts 301–305. FIG. 5 shows a schematic representation of the system 111 with a shingled stack 360 on belts 301–305. The shingled stack 360 includes lowermost segment 362 underlying segments 363–367, all of which are mutually offset in the X direction by a predetermined lateral distance D. Each segment may represent a single layer of limp material, or a set of multiple layers of limp material.

Figure 5:
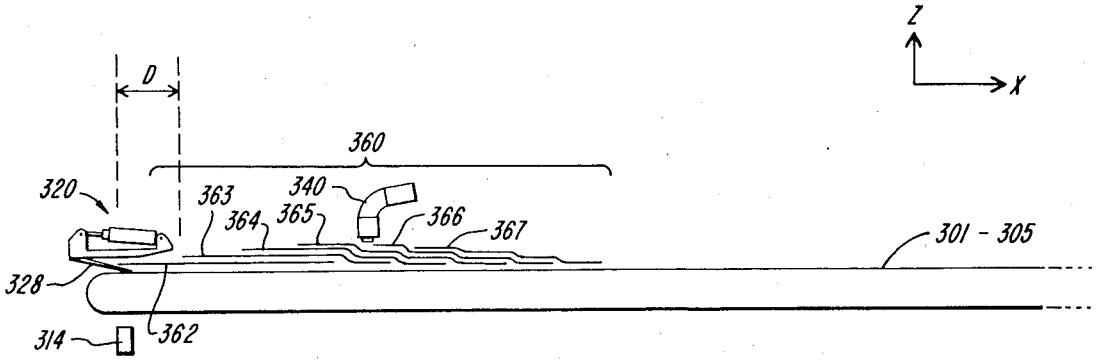
FIG. 5 illustrates in schematic form, a part of the process of the loading of the lowermost segment of shingle stack of segments with the present invention.

Referring to the schematic representation of FIG. 5, the drive motor 312 then advances the position of the stack 360 so that the leading edge of the lowermost segment 362 in the stack overlies the detector 314, as indicated by a signal from detector 314, and actuator 326 controls arm 324 and gripper 320 to move to their retracted position with jaws 328 and 330 positioned about the leading edge of lowermost segment 362. Then actuator 326 positions vacuum nozzle 340 to its first position as shown in FIG. 5, and closes jaws 328 and 330 the actuator 342. Actuator 342 then controls nozzle 340 to be in its second (i.e. middle) position. As a result, the vacuum nozzle 340 provides a lift force to the segments 363—363 of the stack, unweighting the lowermost segment 362. The actuator 326 then controls arm 324 and gripper 320 to move to their extended position, thereby extracting the lowermost segment 362 from the shingled stack 360 and transporting that segment 362 to the loading surface 114*a* of assembly system 110. The actuator 332 then opens jaws 328 and 330, releasing segment 362 on surface 114*a*. At this point, actuator 342 returns nozzle 340 to its first, or uppermost, position. Then the drive motor 312 advances the stack 360 so that the now-lowermost segment 363 overlies detector 314, and actuator 326 returns arm 324 and gripper 320 to their retracted position. The loading process may then repeat on a cyclical basis to extract the now-lowermost segment from the stack 360. All such extractions are performed without disturbing the integrity of limp material layers in either the extracted segment or adjacent segments. Where the vacuum nozzle 340 overlies only the single, next-to-lowermost segment when extraction of the lowermost segment is to occur, the system 111 may be used for both porous and non-porous limp material segments, when the segments are single layered. In embodiments adapted for shingled stacks where the vacuum nozzle is positioned to overlie more than two segments when extraction of the lowermost segment is to occur or where the segments are multilayered, the segments are preferably a porous limp material, such as a woven fabric, so that the lift force applied to those segments by the vacuum is established by the flow of air through those segments and into the nozzle.

In alternate embodiments, the vacuum nozzle 340 may be replaced with device for applying a downward force to segments 363 and the segments adjacent to and above segment 362 in the stack. With that configuration too, the lowermost segment 362 may be extracted from the stack without disturbing the integrity of limp material in adjacent segments.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A system for selectively loading the lowermost segment of a shingled stack of limp material segments to a seam joining apparatus, each segment including one or more adjacent layers of said limp material, wherein adjacent segments of said stack are laterally offset by a predetermined minimum distance, comprising:

A. an endless belt transport system defining a substantially planar transport surface adapted to support said shingled stack of limp material segments thereon, said belt transport system including an associated means for driving said endless belt transport system to selectively transport said stack in the direction of a reference axis, B. detection means for detecting when the leading edge of the lowermost segment of said stack passes a reference point along said reference axis, C. selectively operable extraction means for transporting said lowermost segment in the direction of said reference axis and away from said stack and to said seam joining apparatus, D. selectively operable limit means for applying a limit force to one or more adjacent segments of said stack including the next to lowermost segment but not said lowermost segment, E. controller responsive to said detection means, said controller including means cyclically operative following the loading of a lowermost segment, for:

i. controlling the operation of said drive means in a cycle to advance said shingled stack in the direction of said reference axis until the leading edge of the current lowermost segment passes said reference point, and for maintaining said stack stationary otherwise during a cycle, ii. during a cycle following the time when said leading edge passes said reference point, controlling said limit means to apply said limit force, iii. in association with the initiation of the operation of said limit means in a cycle, controlling said extraction means to perform said transporting of said lowermost segment wherein said endless belt transport system includes a plurality of substantially parallel, transversely spaced apart endless belts, the uppermost surface of said plurality of belts defining said transport surface, and wherein said extraction means includes one or more sets of hinged jaws positioned for movement in the direction of said reference axis and between pairs of said endless belts, said sets of jaws being adapted to selectively grip a portion of said leading edge of said lowermost segment.

2. A system according to claim 1 wherein said limit means includes means for applying an upward force to said one or more adjacent segments.

3. A system according to claim 1 wherein said limit means includes means for applying a downward force to said one or more adjacent segments.

4. A system for selectively loading the lowermost segment of a shingled stack of limp material segments, each segment including one or more adjacent layers of said limp material, wherein adjacent segments of said stack are laterally offset along a reference axis by a predetermined minimum distance, comprising:

A. substantially planar surface adapted to support said shingled stack of limp material segments thereon, in a position whereby the leading edge of said lowermost segment is adjacent to a reference point along said reference axis, B. selectively operable extraction means for transporting said lowermost segment in the direction of said reference axis and away from said stack, and wherein said extraction means includes one or more sets of hinged jaws positioned for movement in the direction of said reference axis between said reference point and a point displaced from said reference point along said reference axis, said sets of jaws being adapted to selectively grip a portion of said leading edge of said lowermost segment when said leading edge is adjacent to said reference point.

5. A system according to claim 4 further comprising selectively operable limit means for applying a limit force to one or more adjacent segments of said stack including the next to lowermost segment but not said lowermost segment.

6. A system according to claim 5 wherein said limit means includes means for applying an upward force to said one or more adjacent segments.

7. A system according to claim 5 wherein said limit means includes means for applying a downward force to said one or more adjacent segments.

* * * * *